US011840680B2

(12) United States Patent
Detering et al.

(10) Patent No.: US 11,840,680 B2
(45) Date of Patent: Dec. 12, 2023

(54) DISHWASHING DETERGENT FORMULATIONS COMPRISING POLYASPARTIC ACID AND GRAFT POLYMERS BASED ON OLIGO- AND POLYSACCHARIDES AS FILM INHIBITING ADDITIVES

(71) Applicant: BASF SE, Ludwigshafen am Rhein (DE)

(72) Inventors: Juergen Detering, Ludwigshafen (DE); Holger Tuerk, Ludwigshafen (DE); Keith E Gutowski, Wyandotte, MI (US); Heike Weber, Ludwigshafen (DE); Gazi Tuerkoglu, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 82 days.

(21) Appl. No.: 17/052,069

(22) PCT Filed: Apr. 29, 2019

(86) PCT No.: PCT/EP2019/060900

§ 371 (c)(1),
(2) Date: Oct. 30, 2020

(87) PCT Pub. No.: WO2019/211231

PCT Pub. Date: Nov. 7, 2019

(65) Prior Publication Data

US 2021/0238504 A1 Aug. 5, 2021

(30) Foreign Application Priority Data

May 2, 2018 (EP) ..... 18170296
Aug. 15, 2018 (EP) ..... 18189159

(51) Int. Cl.

| | |
|---|---|
| ***C11D 3/37*** | (2006.01) |
| ***C11D 3/20*** | (2006.01) |
| ***C11D 3/33*** | (2006.01) |
| ***C11D 11/00*** | (2006.01) |
| ***C11D 17/00*** | (2006.01) |
| ***C11D 1/72*** | (2006.01) |
| ***C11D 3/04*** | (2006.01) |
| ***C11D 3/08*** | (2006.01) |
| ***C11D 3/10*** | (2006.01) |
| ***C11D 3/386*** | (2006.01) |
| ***C11D 3/39*** | (2006.01) |

(52) U.S. Cl.

CPC ..... *C11D 3/3788* (2013.01); *C11D 1/72* (2013.01); *C11D 3/046* (2013.01); *C11D 3/08* (2013.01); *C11D 3/10* (2013.01); *C11D 3/2086* (2013.01); *C11D 3/33* (2013.01); *C11D 3/38609* (2013.01); *C11D 3/3942* (2013.01); *C11D 11/0023* (2013.01); *C11D 17/0091* (2013.01)

(58) Field of Classification Search

None

See application file for complete search history.

(56) References Cited

U.S. PATENT DOCUMENTS

| | | | | |
|---|---|---|---|---|
| 5,039,447 | A | 8/1991 | Reuben | |
| 5,292,447 | A | 3/1994 | Venturello | |
| 5,294,362 | A | 3/1994 | Venturello | |
| 5,422,028 | A | 6/1995 | Oakes | |
| 5,656,646 | A | 8/1997 | Perner et al. | |
| 5,688,902 | A | 11/1997 | Bernard et al. | |
| 5,747,635 | A | 5/1998 | Kroner et al. | |
| 5,972,508 | A * | 10/1999 | Boeckh | B01J 13/14 427/213.3 |
| 6,462,006 | B1 | 10/2002 | Sorg et al. | |
| 2016/0222163 | A1 | 8/2016 | Detering et al. | |
| 2016/0222322 | A1* | 8/2016 | Detering | C11D 3/3719 |
| 2017/0130168 | A1* | 5/2017 | Türk | C11D 3/0036 |
| 2017/0145352 | A1* | 5/2017 | Türk | C11D 3/3942 |
| 2019/0136152 | A1* | 5/2019 | Weber | C11D 3/2086 |
| 2019/0367842 | A1* | 12/2019 | Tuerk | C11D 3/33 |

FOREIGN PATENT DOCUMENTS

| | | | |
|---|---|---|---|
| DE | 4221875 | A1 | 1/1994 |
| DE | 19819187 | A1 | 11/1999 |
| EP | 0851023 | A2 | 7/1998 |
| EP | 2138560 | A1 * | 12/2009 |
| RU | 94041189 | A | 7/1996 |

(Continued)

OTHER PUBLICATIONS

International Search Report and Written Opinion for corresponding PCT/EP2019/060900, dated Jun. 7, 2019, 10 pages.

(Continued)

*Primary Examiner* — Lorna M Douyon

(74) *Attorney, Agent, or Firm* — Armstrong Teasdale LLP

(57) ABSTRACT

Described herein is a dishwashing detergent formulation, including (a) 1-15% by weight of the total composition of (a1) at least one of polyaspartic acid or modified polyaspartic acid or salts thereof, and (a2) at least one graft copolymer composed of wherein the weight ratio of (a1):(a2) is from 20:1 to 1:12;

(b) 0-60% by weight of complexing agent;

(c) 0.1-80% by weight of builders and/or cobuilders;

(d) 0.1-20% by weight of nonionic surfactants;

(e) 0-30% by weight of bleaches and bleach activators;

(f) 0-10% by weight of enzymes and enzyme stabilizers; and (g) 0-50% by weight of additives.

4 Claims, No Drawings

(56) References Cited

FOREIGN PATENT DOCUMENTS

| | | | | |
|---|---|---|---|---|
| RU | 2673814 | C2 | | 11/2018 |
| WO | 2011001170 | A1 | | 1/2011 |
| WO | 2015036325 | A1 | | 3/2015 |
| WO | 2015197378 | A1 | | 12/2015 |
| WO | 2015197379 | A1 | | 12/2015 |
| WO | WO 2015/197378 | A1 | * | 12/2015 |
| WO | 2017186524 | A1 | | 11/2017 |

OTHER PUBLICATIONS

International Preliminary Report on Patentability for corresponding PCT/EP2019/060900, dated Jul. 14, 2020, 14 pages.

* cited by examiner

DISHWASHING DETERGENT FORMULATIONS COMPRISING POLYASPARTIC ACID AND GRAFT POLYMERS BASED ON OLIGO- AND POLYSACCHARIDES AS FILM INHIBITING ADDITIVES

CROSS-REFERENCE TO RELATED APPLICATIONS

This application is a U.S. National Phase Application of International Patent Application No. PCT/EP2019/060900, filed on Apr. 29, 2019, which claims the benefit of priority to European Patent Application Number 18189159.9, filed Aug. 15, 2018, and to European Patent Application Number 18170296.0, filed May 2, 2018, the entire contents of which are hereby incorporated by reference herein.

The present invention relates to dishwashing detergent formulations comprising polyaspartic acid or modified polyaspartic acid and graft polymers based on oligo- and polysaccharides as film inhibiting additives, and the combined use of the polyaspartic acid or modified polyaspartic acid and the graft polymers as film inhibiting additives in dishwashing detergent formulations, in particular in phosphate-free and phosphonate-free automatic dishwashing detergent formulations.

Polymers of carboxyl group containing monomers and obtainable by radical polymerization have been an important constituent of phosphate-containing and phosphate-free automatic dishwashing detergents (ADW) for many years. As a result of their soil-dispersing and film-inhibiting effect, they make a considerable contribution to the cleaning and clear rinse performance of the machine dishwashing detergents. For example, they ensure that no salt deposits of the hardness-forming calcium and magnesium ions are left behind on the ware. Homopolymers and copolymers of acrylic acid are often used for this purpose.

A disadvantage of these polymers of carboxyl group containing monomers obtainable by radical polymerization is that they are not biodegradable under aerobic conditions, as prevail e.g. in a communal sewage plant.

On account of increasing environmental awareness, the demand for biodegradable polymeric alternatives to the polycarboxylates based on acrylic acid is therefore growing. However, commercially available biodegradable polymers such as, for example, polyaspartic acid or carboxymethylated inulin have only gained acceptance in commercial terms with difficulty. The reasons are manifold: inadequate effect in the specific application, excessively high costs on account of complex production processes and/or expensive feed materials.

WO 2011/001170 describes cleaning compositions for machine dishwashing, comprising polyaspartic acid, a liquid nonionic surfactant and at least one solid nonionic surfactant.

WO 2015/036325 describes the use of modified polyaspartic acids in dishwashing detergents, in particular as dispersants, film inhibitors and spot inhibitors. The invention also relates to dishwashing detergent compositions containing modified polyaspartic acids.

WO 2015/197378 claims dishwashing detergents with low film formation on glass containing (A) at least one compound selected from methylglycine diacetate (MGDA) and glutamic acid diacetate (GLDA), and salts thereof, (B) at least one graft copolymer composed of
  (a) at least one graft base selected from monosaccharides, disaccharides, oligosaccharides and polysaccharides, and side chains obtainable by grafting on of
  (b) at least one ethylenically unsaturated mono- or dicarboxylic acid and
  (c) at least one ethylenically unsaturated N-containing monomer with a permanent cationic charge, and (C) at least one inorganic peroxide compound selected from sodium peroxodisulfate, sodium perborate and sodium percarbonate.

WO 2015/197379 claims dishwashing detergents with low film formation on glass containing (A) at least one compound selected from methylglycine diacetate (MGDA) and glutamic acid diacetate (GLDA) and salts thereof, (B) at least one graft copolymer composed of
  (a) at least one graft base selected from nonionic monosaccharides, disaccharides, oligosaccharides and polysaccharides, and side chains obtainable by grafting on of
  (b) at least one ethylenically unsaturated mono- or dicarboxylic acid and
  (c) at least one compound of the general formula (I), (I)

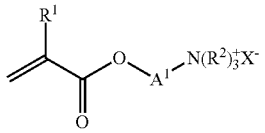

where the variables are defined as follows:

$R^1$ is selected from methyl and hydrogen, $A^1$ is selected from C2-C4-alkylene, $R^2$ are identical or different and selected from C1-C4-alkyl, $X^-$ is selected from halide, mono-C1-C4-alkyl sulfate and sulfate.

It was an object of the invention to provide improved dishwashing detergent additives for film (scale) and spot inhibition, in particular as additives to phosphate-free dishwashing detergent formulations for machine dishwashing, which are biodegradable.

The object is solved by the combined use of (a1) at least one of polyaspartic acid or modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of the co-condensates with the addition of a base, and (a2) at least one graft copolymer composed of (a21) at least one graft base selected from oligosaccharides and polysaccharides, and side chains obtainable by grafting on of (a22) at least one ethylenically unsaturated mono- or dicarboxylic acid and (a23) at least one ethylenically unsaturated N-containing monomer with a permanent cationic charge, wherein the weight ratio of (a1):(a2) is from 20:1 to 1:12 as film inhibiting additives in dishwashing detergent formulations, preferably in automatic dishwashing detergent formulations.

The object is further solved by a composition of (a1) at least one of polyaspartic acid or modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of the co-condensates with the addition of a base, (a2) at least one graft copolymer composed of (a21) at least one graft base selected from, oligosaccharides and polysaccharides, and side chains obtainable by grafting on of (a22) at least one ethylenically unsaturated mono- or dicarboxylic acid and (a23) at least one ethylenically unsaturated N-containing monomer with a permanent cationic charge, wherein the weight ratio of (a1):(a2) is from 20:1 to 1:12.

It was surprisingly found that the combined use of biodegradable polyaspartic acid or modified polyaspartic acid or salts thereof (a1) and biodegradable graft polymer (a2) prepared by grafting of at least one ethylenic unsaturated mono- or dicarboxylic acid and at least one N-containing cationic monomer onto oligo- and polysaccharides leads to dramatically improved cleaning result. The combination is especially effective in preventing film formation (scaling) on glass.

The weight ratio of aspartic or modified aspartic acid (a1) to graft polymer (a2) is preferably from 12:1 to 1:6 more preferably from 12:1 to 1:3 particularly preferably from 12:1 to 1:1, in particular from 12:1 to 3:1, especially form 10:1 to 3:1.

The polyaspartic or modified polyaspartic acid (a1) and graft copolymer (a2) can be incorporated directly into the formulations in their various presentation forms (e.g. as aqueous solution, powder or granules) by processes known to the person skilled in the art. In this connection, solid formulations such as powders, tablets, gel-like formulations and liquid formulations, inter alia, are to be mentioned.

Usually it is difficult to prepare aqueous solutions of polymers of different chemical nature without getting phase separation or precipitation due to polymer-polymer incompatibilities. Surprisingly it was found that aqueous mixtures of polyaspartic or modified polyaspartic acid (a1) and graft copolymer (a2) do not suffer from incompatibilities and form stable solutions. It is possible to prepare stable aqueous mixtures of (a1) and (a2) of various concentrations (e.g. 20, 25, 30, 35 or 40 weight %, based on solid material) and (a1):(a2) weight ratios, e.g. 12:1, 6:1, 3:1, 1:1 or 1:3 by processes known to the person skilled in the art. From these aqueous solutions solid mixtures can be achieved by known processes such as spray drying, spray granulation, fluidized-bed spray granulation, roller drying or freeze drying. Solid mixtures of (a1) and (a2) can also be prepared by mixing (a1) and (a2), both being already in powder or granule form, by solid/solid mixing processes, e.g. by using paddle mixer, drum mixer or rotary drum mixer.

In one preferred embodiment of the present invention mixtures of polyaspartic or modified polyaspartic acid (a1) and graft copolymer (a2) are incorporated into the formulations in their various presentation forms, e.g. as aqueous solution, powder or granules by processes known to the person skilled in the art. In this connection, solid formulations such as powders, tablets, gel-like formulations and liquid formulations, inter alia, are to be mentioned.

The object is further solved by a dishwashing detergent formulation, comprising (a) 1-15% by weight, preferably 2 to 12% by weight, particularly preferably 3 to 10% by weight of the total composition of (a1) polyaspartic acid or modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of the co-condensates with the addition of a base, and (a2) at least one graft copolymer composed of (a21) at least one graft base selected from monosaccharides, disaccharides, oligosaccharides and polysaccharides, and side chains obtainable by grafting on of (a22) at least one ethylenically unsaturated mono- or dicarboxylic acid and (a23) at least one ethylenically unsaturated N-containing monomer with a permanent cationic charge, wherein the weight ratio of (a1):(a2) is from 20:1 to 1:12;

(b) 0-60% by weight of complexing agent;

(c) 0.1-80% by weight of builders and/or cobuilders;

(d) 0.1-20% by weight of nonionic surfactants;

(e) 0-30% by weight of bleaches and bleach activators;

(f) 0-10% by weight of enzymes and enzymes stabilizers; and (g) 0-50% by weight of additives.

The sum of components (a1) to (a2) accounts for 1 to 15% by weight of the total composition. The sum of components (a1), (a2) and (b), (c) (d), (e) (f) and (g) accounts for 100% by weight of the total composition. When the dishwashing detergent formulation of the invention is being formulated, components (a1) and (a2) can be added separately, or can be added as a precompounded film inhibiting composition.

Polyaspartic acid is well known as biodegradable dispersing and scale inhibiting polymer. Three main methods have been developed for the industrial production of polyaspartic acid and its sodium salts:

(1) Thermal polycondensation of aspartic acid followed by alkaline hydrolysis of the intermediate polysuccinimide;

(2) Thermal polycondensation of aspartic acid in the presence of an acid catalyst such as phosphoric acid, sulfuric acid or methanesulfonic acid followed by alkaline hydrolysis of the intermediate polysuccinimide;

(3) Polymerization of maleic acid anhydride in the presence of ammonia or ammonium salts followed by alkaline hydrolysis of the intermediate polysuccinimide.

Regardless of the synthesis route, the intermediate polysuccinimide has to be hydrolyzed by means of e.g. sodium hydroxide in order to obtain an aqueous polyaspartate solution. Acidification of the polyaspartate solution with mineral acids such as hydrochlorid or sulfur acid gives the polyaspartic acid.

Modified polyaspartic acid which can be used according to the present invention is preparable by polycondensation of (i) 50 to 99 mol %, preferably 60 to 95 mol %, particularly preferably 80 to 95 mol %, of aspartic acid; and (ii) 1 to 50 mol %, preferably 5 to 40 mol %, particularly preferably 5 to 20 mol %, of at least one carboxyl-containing compound, and subsequent hydrolysis of the co-condensates with the addition of a base, for example sodium hydroxide solution, wherein (ii) is not an aspartic acid.

The carboxyl-containing compound (ii) used in connection with the preparation of the polyaspartic acid to be used according to the invention can be, inter alia, a carboxylic acid (monocarboxylic acid or polycarboxylic acid), a hydroxycarboxylic acid and/or an amino acid (apart from aspartic acid). Such carboxylic acids or hydroxycarboxylic acids are preferably polybasic. In this connection, polybasic carboxylic acids can thus be used in the preparation of the polyaspartic acid to be used according to the invention, e.g. oxalic acid, adipic acid, fumaric acid, maleic acid, itaconic acid, aconitic acid, succinic acid, malonic acid, suberic acid, azelaic acid, diglycolic acid, glutaric acid, $C_1$-$C_{26}$ alkylsuccinic acids (e.g. octylsuccinic acid), $C_2$-$C_{26}$ alkenylsuccinic acids (e.g. octenylsuccinic acid), 1,2,3-propanetricarboxylic acid, 1,1,3,3-propanetetracarboxylic acid, 1,1,2,2-ethanetetracarboxylic acid, 1,2,3,4-butanetetracarboxylic acid, 1,2,2,3-propanetetracarboxylic acid, or 1,3,3,5-pentanetetracarboxylic acid. Furthermore, in this connection it is also possible to use polybasic hydroxycarboxylic acids, e.g. citric acid, isocitric acid, mucic acid, tartaric acid, tartronic acid, or malic acid. Amino acids that can be used in this connection are, inter alia, aminocarboxylic acids (e.g. glutamic acid, cysteine), basic diaminocarboxylic acids (e.g. lysine, arginine, histidine, aminocaprolactam), neutral amino acids (e.g. glycine, alanine, valine, leucine, isoleucine, methionine, cysteine, norleucine, caprolactam, asparagine, isoasparagine, glutamine, isoglutamine), aminosulfonic acids (e.g. taurine), hydroxylamino acids (e.g. hydroxyproline, serine, threonine), iminocarboxylic acids (e.g. proline, iminodiacetic acid), or aromatic and heterocyclic amino acids (e.g. anthranilic acid, tryptophan, tyrosine, histidine), but not aspartic acid. Preferred carboxyl-containing compounds (ii) in connection with the preparation of the modified polyaspartic acids to be used according to the invention are 1,2,3,4-butanetetracarboxylic acid, citric acid, glycine, glutamic acid, itaconic acid, succinic acid, taurine, maleic acid and glutaric acid, particularly preferably 1,2,3,4-butanetetracarboxylic acid, citric acid, glycine and glutamic acid.

The molecular weight (Mw) of the (modified) polyaspartic acid can easily be tuned by varying the reaction conditions. Molecular weights between 1000 g/mol and 100 000 g/mol can be achieved by simple adjustion of the process parameters (temperature, catalyst, reaction time).

The preferred molecular weight of the (modified) polyaspartic acid used according to the present invention lies in the range between 1000 g/mol and 20 000 g/mol, preferably between 1500 and 15 000 g/mol and particularly preferably between 2000 and 10 000 g/mol.

The aspartic acid (i) used in connection with the preparation of the (modified) polyaspartic acid to be used according to the invention can either be L- or D- and DL-aspartic acid. Preference is given to using L-aspartic acid.

By virtue of the preparation process for (modified) polyaspartic acid described herein, following the step of the hydrolysis with the addition of a base, firstly the (modified) polyaspartic acid is obtained in salt form, as the person skilled in the art readily recognizes. The acid form of the (modified) polyaspartic acid can be obtained directly by a further step of acidification of the salt, which can be carried out in a manner known to the person skilled in the art. Suitable acids for this are, inter alia, mineral acids, for example sulfuric acid or hydrochloric acid. If only the salt of (modified) polyaspartic acid is desired, for example as intermediate, it is possible to dispense with the step of subsequent acidification. Wherever (modified) polyaspartic acid is discussed in connection with the present invention, its corresponding salts are accordingly also encompassed, as are obtainable or obtained by specified subsequent step of acidification and as recognized by the person skilled in the art. The optional acidification of the salt of (modified) polyaspartic acid can take place, for example, by adding a defined amount of a concentrated or dilute mineral acid such as, for example, sulfuric acid or hydrochloric acid to an aqueous sodium salt solution of the (modified) polyaspartic acid. The acidification can also take place by treatment with an acidic ion exchanger such as, for example, Amberlite IR 120 (hydrogen form), by allowing the aqueous Na salt solution of the (modified) polyaspartic acid to flow over a column packed with the ion exchanger.

Bases which can be used for the hydrolysis of the polysuccinimide respectively of the cocondensates in the preparation of the modified polyaspartic acids to be used according to the invention are: alkali metal and alkaline earth metal bases such as sodium hydroxide solution, potassium hydroxide solution, calcium hydroxide or barium hydroxide; carbonates such as sodium carbonate and potassium carbonate; ammonia and primary, secondary or tertiary amines; other bases with primary, secondary or tertiary amino groups. In connection with the present invention, preference is given to sodium hydroxide solution or ammonium hydroxide.

The preparation of the (modified) polyaspartic acids to be used according to the invention takes place generally via a poly(co)condensation of aspartic acid, optionally with at least one carboxyl-containing compound (not aspartic acid) and subsequent hydrolysis of the obtained (co)condensates with the addition of a base as illustrated and described above and below. The preparation of such (modified) polyaspartic acids is also described, by way of example in DE 4221875.6. The preparation of the (modified) polyaspartic acids to be used according to the invention is described by way of example hereinbelow. This preparation description must not be understood as being limiting with regard to the (modified) polyaspartic acids to be used according to the invention. The (modified) polyaspartic acids to be used according to the invention comprise not only those which are prepared by the following preparation description, but also those which are preparable by the subsequent process. The (modified) polyaspartic acids to be used according to the invention can be prepared e.g. by poly(co)condensation of components (i) and optionally (ii), i.e. aspartic acid and optionally at least one carboxyl-containing compound in the molar ratios as described herein. The poly(co)condensation can take place at temperatures from 100 to 270° C., preferably at 120 to 250° C., particularly preferably at 180 to 220° C. The condensation (the heating) is preferably carried out in vacuo or under an inert gas atmosphere (e.g. $N_2$ or argon). However, the condensation can also take place under increased pressure or in a gas stream, e.g. carbon dioxide, air, oxygen or water vapor. The reaction times for the condensation are generally between 1 minute and 50 hours, preferably between 5 and 8 hours, depending on the chosen reaction conditions. The poly(co)condensation can be carried out, for example, in solid phase, by firstly preparing an aqueous solution or suspension of aspartic acid and optionally at least one carboxyl-containing compound (ii) and evaporating the solution to dryness. During this, a condensation may already start. Examples of suitable reaction apparatuses for the condensation are heating belts, kneaders, mixers, paddle dryers, extruders, rotary kilns and other heatable devices in which the condensation of solids can be carried out with the removal of water of reaction. Poly(co)condensates with a low molecular weight can be prepared in also pressure-tight sealed vessels by not removing, or only partially removing, the water of reaction which is formed. The poly(co)condensation can also be carried out by infrared radiation or microwave radiation. An acid-catalyzed poly(co)condensation is also possible, for example with inorganic acids of phosphorus or sulfur or with hydrogen halides. Acid-catalyzed polycondensations of this type are also described in DE 4221875.6.

By adding small amounts of methanesulfonic acid during the poly(co)condensation of aspartic acid and optionally the at least one carboxyl-containing compound, it is possible to control the molecular weight of the (modified) polyaspartic acid, obtained following hydrolysis of the polysuccinimide intermediate respectively of the co-condensates. In the context of the present invention, it is thus possible to prepare (modified) polyaspartic acid to be used according to the invention by also using methanesulfonic acid as additive in the poly(co)condensation besides aspartic acid (i) and the optional carboxyl-containing compound (ii), and then hydrolyzing the resulting condensate with a base as described here. Methanesulfonic acid is biodegradable like polyaspartic acid. Small amounts of methanesulfonic acid can remain in the polymer product without ecological disadvantages arising and without the performance in numerous applications being influenced. Complex work-up or purification is unnecessary. Yield losses as a result of work-up are avoided.

During the thermal poly(co)condensation of aspartic acid (with or without methanesulfonic acid), the poly(co)condensate is generally produced in the form of the water-insoluble polysuccinimide or respective polysuccinimide-cocondensate, in a few cases in water-soluble form (e.g. in the case of the polycondensation of L-aspartic acid with citric acid). The condensates of aspartic acid can be purified from the unreacted starting materials, for example, by comminuting the condensation product and extracting it with water at temperatures from 10 to 100° C. During this, the unreacted feed materials are dissolved out and optionally used methanesulfonic acid is washed out. Unreacted aspartic acid can be easily dissolved out by extraction with 1 N hydrochloric acid.

The (modified) polyaspartic acids are preferably obtained from the poly(co)condensates by slurrying the poly(co) condensates in water, or dissolving them (if the polycondensate is already water-soluble, e.g. polycocondensate from L-aspartic acid and citric acid), and hydrolyzing and neutralizing them at temperatures preferably in the range from 0 to 90° C. with the addition of a base. The hydrolysis and neutralization preferably takes place at a pH of 8 to 10. Suitable bases are, for example, alkali metal and alkaline earth metal bases such as sodium hydroxide solution, potassium hydroxide solution, calcium hydroxide or barium hydroxide. Suitable bases are also, for example, carbonates such as sodium carbonate and potassium carbonate. Suitable bases are also ammonia and primary, secondary or tertiary amines and other bases with primary, secondary or tertiary amino groups. If using amines for the reaction of polysuccinimide or the respective polysuccinimide-cocondensate, the amines can be bonded to the polyaspartic acid either like a salt or like an amide on account of their high reactivity.

In the case of the treatment with bases, neutralized (modified) polyaspartic acid are obtained in the form of the salts corresponding to the bases.

The (modified) polyaspartic acids to be used according to the invention and/or their salts can be used as aqueous solution or in solid form, e.g. in powder or granule form. As is known to the person skilled in the art, the powder or granule form can be obtained for example by spray drying, spray granulation, fluidized-bed spray granulation, roller drying or freeze drying of the aqueous solution of the polyaspartic acids or their salts.

Compositions according to the present invention further comprise (a2) at least one graft copolymer which in the context of the present invention is also called graft copolymer (a2) and which is composed of (a21) at least one graft base, for short called graft base (a21), which is selected from oligosaccharides and polysaccharides, and side chains obtainable by grafting on of (a22) at least one ethylenically unsaturated mono- or dicarboxylic acid, for short called monocarboxylic acid (a22) or dicarboxylic acid (a22), and (a23) at least one ethylenically unsaturated N-containing monomer with a permanent cationic charge, for short called monomer (a23).

In the context of the present invention, oligosaccharides that may be mentioned are carbohydrates with three to ten monosaccharide units per molecule, for example glycans. In the context of the present invention, polysaccharides is the term used to refer to carbohydrates with more than ten monosaccharide units per molecule. Oligo- and polysaccharides may be for example linear, cyclic or branched.

Polysaccharides to be mentioned by way of example are biopolymers such as starch and glycogen, and cellulose, dextran and tunicin. Furthermore, mention is to be made of inulin as polycondensate of D-fructose (fructans), chitin and alginic acid. Further examples of polysaccharides are starch degradation products, for example products which can be obtained by enzymetic or so-called chemical degradation of starch. Examples of the so-called chemical degradation of starch are oxidative degradation and acid-catalyzed hydrolysis.

Preferred examples of starch degradation products are maltodextrins and glucose syrup. In the context of the present invention, maltodextrin is the term used to refer to mixtures of monomers, dimers, oligomers and polymers of glucose. The percentage composition differs depending on the degree of hydrolysis. This is described by the dextrose equivalent, which in the case of maltodextrin is between 3 and 40.

Preferably, the graft base (a21) is selected from polysaccharides, in particular from starch, which is preferably not chemically modified. In one embodiment of the present invention, starch is selected from those polysaccharides which have in the range from 20 to 30% by weight amylose and in the range from 70 to 80% amylopectin. Examples are corn starch, rice starch, potato starch and wheat starch.

Side chains are grafted on to the graft base (a21). Per molecule of graft copolymer (a2), preferably on average one to ten side chains can be grafted on. Preferably, in this connection, a side chain is linked with the anomeric carbon atom of a monosaccharide or with an anomeric carbon atom of the chain end of an oligo- or polysaccharide. The number of side chains is limited upwards by the number of carbon atoms with hydroxyl groups of the graft base (a21) in question.

Examples of monocarboxylic acids (a22) are ethylenically unsaturated $C_3$-$C_{10}$-monocarboxylic acids and the alkali metal or ammonium salts thereof, in particular the potassium and the sodium salts. Preferred monocarboxylic acids (a22) are acrylic acid and methacrylic acid, and also sodium (meth)acrylate. Mixtures of ethylenically unsaturated $C_3$-$C_{10}$ monocarboxylic acids and in particular mixtures of acrylic acid and methacrylic acid are also preferred components (a22).

Examples of dicarboxylic acids (a22) are ethylenically unsaturated $C_4$-$C_{10}$-dicarboxylic acids and their mono- and in particular dialkali metal or ammonium salts, in particular the dipotassium and the disodium salts, and also anhydrides of ethylenically unsaturated $C_4$-$C_{10}$-dicarboxylic acids. Preferred dicarboxylic acids (a22) are maleic acid, fumaric acid, itaconic acid, and also maleic anhydride and itaconic anhydride.

In one embodiment, graft copolymer (a2) comprises in at least one side chain, besides monomer (a23) at least one monocarboxylic acid (a22) and at least one dicarboxylic acid (a22). In a preferred embodiment of the present invention, graft copolymer (a2) comprises in polymerizedin form in the side chains, besides monomer (a23), exclusively monocarboxylic acid (a22), but no dicarboxylic acid (a22).

Examples of monomers (a23) are ethylenically unsaturated N-containing compounds with a permanent cationic charge, i.e. those ethylenically unsaturated N-containing compounds which form ammonium salts with anions such as sulfate, 01-C4-alkyl sulfates and halides, in particular with chloride, and independently of the pH. Any desired mixtures of two or more monomers (a23) are also suitable.

Examples of suitable monomers (a23) are the correspondingly quaternized derivatives of vinyland allyl-substituted nitrogen heterocycles such as 2-vinyl pyridine and 4-vinylpyridine, 2-allylpyridine and 4-allylpyridine, and also N-vinylimidazole, e.g. 1-vinyl-3-methylimidazolium chloride. Also of suitability are the correspondingly quaternized derivatives of N,N-diallylamines and N,N-diallyl-N-alkylamines, such as e.g. N,N-diallyl-N,N-dimethylammonium chloride (DADMAC).

In one embodiment of the present invention, monomer (a23) is selected from correspondingly quaternized, ethylenically unsaturated amides of mono- and dicarboxylic acids with diamines which have at least one primary or secondary amino group. Preference is given here to those diamines which have one tertiary and one primary or secondary amino group.

In another embodiment of the present invention, monomer (a23) is selected from correspondingly quaternized, ethylenically unsaturated esters of mono- and dicarboxylic acids with C2-C12-amino alcohols which are mono- or dialkylated on the amine nitrogen.

Of suitability as acid component of the aforementioned esters and amides are e.g. acrylic acid, methacrylic acid, fumaric acid, maleic acid, itaconic acid, crotonic acid, maleic anhydride, monobutyl maleate and mixtures thereof. As acid component, preference is given to using acrylic acid, methacrylic acid and mixtures thereof.

Preferred monomers (a23) have the general formula (I), (I)

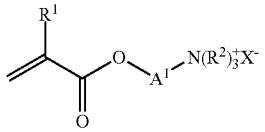

wherein the variables are defined as follows:

Z is O or $NR^1$, $R^1$ is selected from methyl and hydrogen, $A^1$ is selected from $C_2$-$C_4$-alkylene, $R^2$ are identical or different and selected from $C_1$-$C_4$-alkyl, $X^-$ is selected from halide, mono-$C_1$-$C_4$-alkyl sulfate and sulfate.

Particular preferred monomers (a23) are trialkylaminoethyl (meth)acrylatochloride or alkyl sulfate and trialkylaminopropyl (meth)acrylatochloride or alkyl sulfate, and also (meth)acrylamidoethyltrialkylammonium chloride or alkyl sulfate and (meth)acrylamidopropyltrialkylammonium chloride or alkyl sulfate, where the respective alkyl radical is preferably methyl or ethyl or mixtures thereof.

Very particular preference is given to (meth)acrylamidopropyltrimethylammonium halide, in particular acrylamidopropyltrimethylammonium chloride ("APTAC") or methacrylamidopropyltrimethylammonium chloride ("MAPTAC").

APTAC

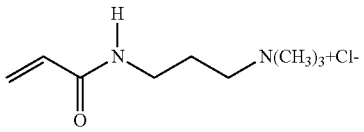

MAPTAC

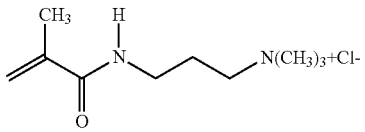

In another preferred embodiment of the present invention, monomer (a23) is selected from trimethylammonium $C_2$-$C_3$-alkyl(meth)acrylatohalide, in particular 2-(trimethylamino) ethyl(meth)acrylatochloride and 3-(trimethylamino)propyl (meth)acrylatochloride.

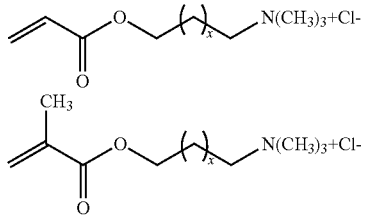

x = 0 or 1

Graft copolymer (a2) can comprise, in polymerized-in form, in one or more side chains at least one further comonomer (a24), for example hydroxyalkyl esters such as 2-hydroxyethyl (meth)acrylate or 3-hydroxypropyl (meth) acrylate, or esters of alkoxylated fatty alcohols, or comonomers containing sulfonic acid groups, for example 2-acrylamido-2-methylpropanesulfonic acid (AMPS) and its alkali metal salts.

Preferably, graft copolymer (a2) comprises no further comonomers (a24) in one or more side chains apart from monomer (a23) and monocarboxylic acid (a22) or dicarboxylic acid (a22).

In one embodiment of the present invention, the fraction of graft base (a21) in graft copolymer (a2) is in the range from 40 to 95% by weight, preferably from 50 to 90% by weight, in each case based on total graft copolymer (a2).

In one embodiment of the present invention, the fraction of monocarboxylic acid (a22) or dicarboxylic acid (a22) is in the range from 2 to 40% by weight, preferably from 5 to 30% by weight and in particular from 5 to 25% by weight, in each case based on total graft copolymer (a2).

The monomers of type (a23) are polymerized in amounts of from 5 to 50% by weight, preferably from 5 to 40% by weight and particularly preferably from 5 to 30% by weight, in each case based on total graft copolymer (a2).

It is preferred if graft copolymer (a2) comprises, in polymerized-in form, more monocarboxylic acid (a22) than compound (a23), and specifically based on the molar fractions, for example in the range from 1.1:1 to 5:1, preferably 2:1 to 4:1.

In one embodiment of the present invention, the average molecular weight ($M_w$) of graft copolymer (a2) is in the range from 2000 to 200 000 g/mol, preferably from 5000 to 150 000 and in particular in the range from 8000 to 100 000 g/mol. The average molecular weight $M_w$ is measured preferably by gel permeation chromatography in aqueous KCl/formic acid solution.

Graft copolymer (a2) can preferably be obtained as aqueous solution from which it can be isolated, e.g. by spray drying, spray granulation or freeze drying.

If desired, solution of graft copolymer (a2) or dried graft copolymer (a2) can be used for producing the formulations according to the invention.

Monomer (a23) per se can be polymerized in graft copolymer (a2) or a non quaternized equivalent, in the case of APTAC for example

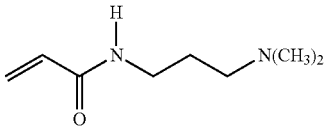

and in the case of MAPTAC with

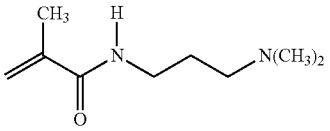

and the copolymerization can be followed by alkylation, for example with $C_1$-$C_8$-alkyl halide or di-$C_1$-$C_4$-alkyl sulfate, for example with ethyl chloride, ethyl bromide, methyl chloride, methyl bromide, dimethyl sulfate or diethyl sulfate.

It is preferred to stabilize graft copolymer (a2) by at least one biocide. Examples of suitable biocides are isothiazolinones, for example 1,2-benzisothiazolin-3-one ("BIT"), octylisothiazolinone ("OIT"), dichlorooctylisothiazolinone ("DCOIT"), 2-methyl-2H-isothiazolin-3-one ("MIT") and 5-chloro-2-methyl-2H-isothiazolin-3-ones ("CIT"), phenoxyethanol, alkylparabens such as methylparaben, ethylparaben, propylparaben, benzoic acid and its salts such as e.g. sodium benzoate, benzyl alcohol, alkali metal sorbates such as e.g. sodium sorbate, and (substituted) hydantoins such as e.g. 1,3-bis(hydroxymethyl)-5,5-dimethylhydantoin (DMDM hydantoin). Further examples are 1,2-dibromo-2,4-dicyanobutane, iodo-2-propynyl butylcarbamate, iodine and iodophores.

The scale inhibiting composition comprising polyaspartic acid or modified polyaspartic acid (a1) and graft copolymer (a2) as described herein and to be used according to the invention can be used particularly advantageously in machine dishwashing detergents. They are characterized here in particular by their film-inhibiting effect both towards inorganic and organic films. In particular, they inhibit films made of calcium and magnesium carbonate and calcium and magnesium phosphates and phosphonates. Additionally, they prevent deposits which originate from the soil constituents of the wash liquor, such as grease, protein and starch films.

The scale inhibiting composition described herein can be used either in multicomponent product systems (separate use of detergent, rinse aid and regenerating salt), or else in those dishwashing detergents in which the functions of detergent, rinse aid and regenerating salt are combined in one product (e.g. 3-in-1 products, 6-in-1 products, 9-in-1 products, all-in-one products).

The present invention also relates to dishwashing detergent formulations, in particular dishwashing detergent formulations suitable for machine dishwashing which, besides the polyaspartic or modified polyaspartic acid (a1) and graft copolymer (a2) described above and to be used according to the invention, also comprise complexing agents, builders and/or cobuilders, nonionic surfactants, bleaches and/or bleach activators, enzymes and optionally further additives such as solvents. The polyaspartic or modified polyaspartic acid (a1) and graft copolymer (a2) can be incorporated directly into the formulations in their various presentation forms by processes known to the person skilled in the art. In this connection, solid formulations such as powders, tablets, gel-like formulations and liquid formulations, inter alia, are to be mentioned.

The dishwashing detergent formulations according to the invention are suitable in particular as dishwashing detergent composition for machine dishwashing. In one embodiment, the dishwashing detergent composition according to the invention is therefore a machine dishwashing detergent composition.

The dishwashing detergent formulations according to the invention can be provided in liquid, gel-like or solid form, as one or more phases, as tablets or in the form of other dosing units, packaged or unpackaged.

Examples of complexing agents (b) which can be used are: nitrilotriacetic acid, ethylenediaminetetraacetic acid, diethylenetriaminepentaacetic acid, hydroxyethylethylenediaminetriacetic acid, methylglycinediacetic acid, glutamic acid diacetic acid, iminodisuccinic acid, hydroxyiminodisuccinic acid, ethylenediaminedisuccinic acid, aspartic acid diacetic acid, and in each case salts thereof. Preferred complexing agents (b) are methylglycinediacetic acid (MGDA) and glutamic acid diacetic acid (GLDA) and salts thereof. Particularly preferred complexing agents (b) are methylglycinediacetic acid and salts thereof. According to the invention, preference is given to 1 to 50% by weight of complexing agents (b).

MGDA and GLDA can be present as racemate or as enantiomerically pure compound. GLDA is preferably selected from L-GLDA or enantiomerically enriched mixtures of L-GLDA in which at least 80 mol %, preferably at least 90 mol %, of L-GLDA is present.

In one embodiment of the present invention, complexing agent (b) is racemic MGDA. In another embodiment of the present invention, complexing agent (b) is selected from L-MGDA and from enantiomer mixtures of L- and D-MGDA in which L-MGDA predominates and in which the L/D molar ratio is in the range from 55:45 to 95:5, preferably 60:40 to 85:15. The L/D molar ratio can be determined for example by polarimetry or by chromatographic means, preferably by HPLC with a chiral column, for example with cyclodextrin as stationary phase or with an optically active ammonium salt immobilized on the column. For example, it is possible to use an immobilized D-penicillamine salt.

MGDA or GLDA is preferably used as the salt. Preferred salts are ammonium salts and alkali metal salts, particularly preferably the potassium and in particular the sodium salts. These can for example have the general formula (I) or (II):

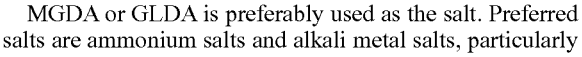

$$[CH_3—CH(COO)—N(CH_2—COO)_2]Na_{3-x-y}K_xH_y \quad (I)$$

x in the range from 0.0 to 0.5, preferably up to 0.25,
y in the range from 0.0 to 0.5, preferably up to 0.25,

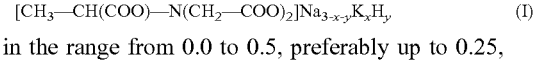

$$[OOC—(CH_2)_2—CH(COO)—N(CH_2—COO)_2]Na_{4-x-y}K_xH_y \quad (II)$$

x in the range from 0.0 to 0.5, preferably up to 0.25,
y in the range from 0.0 to 0.5, preferably up to 0.25.

Very particular preference is given to the trisodium salt of MGDA and the tetrasodium salt of GLDA.

Complexing agent (b) can comprise, in small amounts, cations which are different from alkali metal ions, for example $Mg^{2+}$, $Ca^{2+}$ or iron ions, for example $Fe^{2+}$ or $Fe^{3+}$. Ions of this kind are in many cases present in complexing agent (b) as a consequence of the preparation. Cations different from alkali metal ions are present in one embodiment of the present invention in the range from 0.01 to 5 mol %, based on total MGDA or total GLDA.

In another embodiment of the present invention, no measurable fractions of cations which are different from alkali metal ions are present in the complexing agent (b).

In one embodiment of the present invention, complexing agent (b) comprises small amounts of one or more impurities, which can be as a consequence of the preparation. In the case of MGDA, for example propionic acid, alanine or lactic acid may be. Small amounts in this connection are fractions for example in the range from 0.01 to 1% by weight, based on complexing agent (b). Impurities of this kind are disregarded in the context of the present invention unless expressly stated otherwise.

In one embodiment of the present invention, the formulation according to the invention comprises a complexing agent (b), for example only trisodium salt of MGDA or only tetrasodium salt of GLDA. In this connection, compounds of the formulae (I) or (II) where x or y is not equal to zero should also in each case be referred to as one compound.

In another embodiment of the present invention, the formulation according to the invention comprises two complexing agents (b), for example a mixture of trisodium salt of MGDA and tetrasodium salt of GLDA, for example in a molar ratio in the range from 10:1 to 1:10.

Builders and/or cobuilders (c) that can be used are, in particular, water-soluble or water-insoluble substances, the main task of which consists in the binding of calcium and magnesium ions. These may be low molecular weight carboxylic acids, and salts thereof such as alkali metal citrates, in particular anhydrous trisodium citrate or trisodium citrate dihydrate, alkali metal succinates, alkali metal malonates, fatty acid sulfonates, oxydisuccinate, alkyl or alkenyl disuccinates, gluconic acids, oxadiacetates, carboxymethyloxysuccinates, tartrate monosuccinate, tartrate disuccinate, tartrate monoacetate, tartrate diacetate and α-hydroxypropionoic acid.

A further substance class with cobuilder properties which can be present in the cleaners according to the invention is the phosphonates. These are in particular hydroxylalkane- and aminoalkanephosphonates. Among the hydroxyalkanephosphonates, 1-hydroxyethane-1,1-diphosphonate (HEDP) is of particular importance as cobuilder. It is preferably used as sodium salt, with the disodium salt giving a neutral reaction and the tetrasodium salt an alkaline reaction (pH 9). Suitable aminoalkanephosphonates are preferably ethylenediaminetetramethylenephosphonate (EDTMP), diethylenetriaminepentamethylenephosphonate (DTPMP), and higher homologs thereof. They are preferably used in the form of the neutrally reacting sodium salts, e.g. as hexasodium salt of EDTMP or as hepta- and octasodium salt of DTPMP. The builder used here from the class of phosphonates is preferably HEDP. Moreover, the aminoalkanephosphonates have a marked heavy metal binding capacity. Accordingly, particularly if the compositions also comprise bleaches, it may be preferred to use aminoalkanephosphonates, in particular DTPMP, or to use mixtures of the specified phosphonates.

Preferably, the dishwashing detergent formulations of the invention are phosphonate-free.

Inter alia, silicates can be used as builders. Crystalline layered silicates with the general formula $NaMSi_xO_{2x+1}yH_2O$, may be present, where M is sodium or hydrogen, x is a number from 1.9 to 22, preferably from 1.9 to 4, where particularly preferred values of x are 2, 3 or 4 and y is a number from 0 to 33, preferably 0 to 20. In addition, amorphous sodium silicates with an $SiO_2$:$Na_2O$ ratio of 1 to 3.5, preferably from 1.6 to 3 and in particular from 2 to 2.8, can be used.

Furthermore, builders and/or cobuilders (c) which can be used in connection with the dishwashing detergent formulations according to the invention are carbonates and hydrocarbonates, among which the alkali metal salts, in particular sodium salts, are preferred.

As cobuilders, it is also possible to use homopolymers and copolymers of acrylic acid or of methacrylic acid which preferably have a weight-average molar mass of 2000 to 50 000 g/mol. Suitable comonomers are in particular monoethylenically unsaturated dicarboxylic acids such as maleic acid, fumaric acid and itaconic acid, and anhydrides thereof such as maleic anhydride. Comonomers containing sulfonic acid groups, such as 2-acrylamido-2-methylpropanesulfonic acid, allylsulfonic acid and vinylsulfonic acid, are also suitable. Hydrophobic comonomers are also suitable, such as, for example, isobutene, diisobutene, styrene, alpha-olefins with 10 or more carbon atoms. Hydrophilic monomers with hydroxy function or alkylene oxide groups can likewise be used as comonomers. For example, mention may be made of: allyl alcohol and isoprenol, and alkoxylates thereof and methoxypolyethylene glycol (meth)acrylate. In addition graft polymers based on degraded starch and the aforementioned monomers such as (meth)acrylic acid, maleic acid, fumaric acid and 2-acrylamido-2-methylpropanesulfonic acid can be used as cobuilder.

Preferred amounts of builders and/or cobuilders in connection with the dishwashing detergent formulations according to the invention are 1 to 80% by weight, particularly preferably 2 to 75% by weight, 3 to 70% by weight or 3 to 65% by weight.

Nonionic surfactants (d) which can be used in connection with the dishwashing detergent formulations according to the invention are, for example, weakly foaming or low-foam nonionic surfactants. These can be present in fractions from 0.1 to 20% by weight, preferably from 0.1 to 15% by weight, particularly preferably from 0.25 to 10% by weight or 0.5 to 10% by weight. Suitable nonionic surfactants comprise, inter alia, surfactants of the general formula (I)

$$R^1—O—(CH_2CH_2O)_a—(CHR^2CH_2O)_b—R^3 \quad (I),$$

in which $R^1$ is a linear or branched alkyl radical having 8 to 22 carbon atoms, $R^2$ and $R^3$, independently of one another, are hydrogen or a linear or branched alkyl radical having 1 to 10 carbon atoms or H, where $R^2$ is preferably methyl, and a and b, independently of one another, are 0 to 300. Preferably, a=1-100 and b=0-30.

Also of suitability in the context of the present invention are surfactants of the formula (II)

$$R^4—O—[CH_2CH(CH_3)O]_c[CH_2CH_2O]_d[CH_2CH(CH_3)O]_eCH_2CH(OH)R^5 \quad (II),$$

in which $R^4$ is a linear or branched aliphatic hydrocarbon radical having 4 to 22 carbon atoms or mixtures thereof, $R^5$ is a linear or branched hydrocarbon radical having 2 to 26 carbon atoms or mixtures thereof, c and e are values between 0 and 40, and d is a value of at least 15.

Also suitable in the context of the present invention are surfactants of the formula (III)

$$R^6O—(CH_2CHR^7O)_f(CH_2CH_2O)_g(CH_2CH\ R^8O)_h—CO—R^9 \quad (III),$$

in which $R^6$ is a branched or unbranched alkyl radical having 8 to 16 carbon atoms, $R^7$, $R^8$, independently of one another, are H or a branched or unbranched alkyl radical having 1 to 5 carbon atoms, $R^9$ is an unbranched alkyl radical having 5 to 17 carbon atoms, f, h, independently of one another, are a number from 1 to 5, and g is a number from 13 to 35.

The surfactants of the formulae (I), (II) and (III) can either be random copolymers or block copolymers, they are preferably in the form of block copolymers. Furthermore, in connection with the present invention, it is possible to use di- and multiblock copolymers composed of ethylene oxide and propylene oxide, which are commercially available, for example, under the name Pluronic® (BASF SE) or Tetronic® (BASF Corporation). Furthermore, reaction products of sorbitan esters with ethylene oxide and/or propylene oxide can be used. Likewise of suitability are amine oxides or alkyl glycosides. An overview of suitable nonionic surfactants is disclosed in EP-A 851 023 and in DE-A 198 19 187.

Mixtures of two or more different nonionic surfactants can also be present. The dishwashing detergent compositions according to the invention can furthermore comprise anionic or zwitterionic surfactants, preferably in a mixture with nonionic surfactants. Suitable anionic and zwitterionic surfactants are likewise mentioned in EP-A 851 023 and DE-A 198 19 187.

Bleaches and bleach activators (e) that can be used in connection with the dishwashing detergent formulations according to the invention are representatives known to the person skilled in the art. Bleaches are divided into oxygen bleaches and chlorine-containing bleaches. Oxygen bleaches used are alkali metal perborates and hydrates thereof, as well as alkali metal percarbonates. Preferred bleaches here are sodium perborate in the form of the mono- or tetrahydrate, sodium percarbonate or the hydrates of sodium percarbonate. As oxygen bleaches it is likewise possible to use persulfates and hydrogen peroxide. Typical oxygen bleaches are also organic peracids such as, for example, perbenzoic acid, peroxy-alpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid. Moreover, the following oxygen bleaches can also be used in the dishwashing detergent composition: cationic peroxy acids, which are described in the patent applications U.S. Pat. Nos. 5,422,028, 5,294,362, and 5,292,447, and sulfonylperoxy acids, which are described in the patent application U.S. Pat. No. 5,039,447. Oxygen bleaches can be used in amounts of in general 0.1 to 30% by weight, preferably from 1 to 20% by weight, particularly preferably from 3 to 15% by weight, based on the total dishwashing detergent composition.

Chlorine-containing bleaches as well as the combination of chlorine-containing bleaches with peroxide-containing bleaches can likewise be used in connection with the dishwashing detergent formulations according to the invention. Known chlorine-containing bleaches are, for example, 1,3-dichloro-5,5-dimethylhydantoin, N-chlorosulfamide, chloramine T, dichloramine T, chloramine B, N,N'-dichlorobenzoylurea, p-toluenesulfonedichloroamide or trichloroethylamine. Preferred chlorine-containing bleaches here are sodium hypochlorite, calcium hypochlorite, potassium hypochlorite, magnesium hypochlorite, potassium dichloroisocyanurate or sodium dichloroisocyanurate. Chlorine-containing bleaches can be used in this connection in amounts of from 0.1 to 30% by weight, preferably from 0.1 to 20% by weight, preferably from 0.2 to 10% by weight, particularly preferably from 0.3 to 8% by weight, based on the total dishwashing detergent composition.

Furthermore, bleach stabilizers such as, for example, phosphonates, borates, metaborates, metasilicates or magnesium salts, can be added in small amounts.

Bleach activators in the context of the present invention can be compounds which, under perhydrolysis conditions, produce aliphatic peroxocarboxylic acids having preferably 1 to 10 carbon atoms, in particular 2 to 4 carbon atoms, and/or substituted perbenzoic acid. Of suitability in this connection are, inter alia, compounds which comprise one or more N- or O-acyl groups and/or optionally substituted benzoyl groups, for example substances from the class of anhydrides, esters, imides, acylated imidazoles or oximes. Examples are tetraacetylethylenediamine (TAED), tetraacetylmethylenediamine (TAMD), tetraacetyl glycol uril (TAGU), tetraacetylhexylenediamine (TAHD), N-acylimides, such as, for example, N-nonanoylsuccinimide (NOSI), acylated phenolsulfonates, such as, for example, n-nonanoyl- or isononanoyloxybenzenesulfonates (n- or iso-NOBS), pentaacetyl glucose (PAG), 1,5-diacetyl-2,2-dioxohexahydro-1,3,5-triazine (DADHT) or isatoic anhydride (ISA). Likewise suitable as bleach activators are nitrile quats such as, for example, N-methylmorpholinium acetonitrile salts (MMA salts) or trimethylammonium acetonitrile salts (TMAQ salts). Preferably of suitability are bleach activators from the group consisting of polyacylated alkylenediamines, particularly preferably TAED, N-acylimides, particularly preferably NOSI, acylated phenolsulfonates, particularly preferably n- or iso-NOBS, MMA, and TMAQ. Bleach activators can be used in connection with the present invention in amounts of from 0.1 to 20% by weight, preferably from 0.1 to 10% by weight, preferably from 0.5 to 9% by weight, particularly preferably from 1.0 to 8% by weight, based on the total dishwashing detergent composition.

In addition to the conventional bleach activators, or instead of them, it is also possible to incorporate so-called bleach catalysts into dishwashing detergent formulations. These substances are bleach-boosting transition metal salts or transition metal complexes such as, for example, manganese-, iron-, cobalt-, ruthenium- or molybdenum-salene complexes or carbonyl complexes. Manganese, iron, cobalt, ruthenium, molybdenum, titanium, vanadium and copper complexes with nitrogen-containing tripod ligands, and also cobalt-, iron-, copper- and rutheniumamine complexes can also be used as bleach catalysts.

As component (f), the dishwashing detergent formulations according to the invention can comprise 0 to 10% by weight of enzymes and enzyme stabilizers. If the dishwashing detergent formulations comprise enzymes and enzyme stabilizers, they preferably comprise these in amounts of from 0.1 to 8% by weight. Enzymes can be added to the dishwashing detergent in order to increase the cleaning performance or, under more mild conditions (e.g. at lower temperatures), to ensure the cleaning performance in identical quality. The enzymes can be used in free form or chemically or physically immobilized form on a support, or in encapsulated form. The most often used enzymes include in this connection lipases, amylases, cellulases and proteases. Furthermore, esterases, pectinases, lactases and peroxidases can also be used. According to the invention, preference is given to using amylases and proteases.

Formulations according to the invention can comprise one or more enzyme stabilizers. Enzyme stabilizers serve to protect enzyme—particularly during storage—against damage such as, for example, inactivation, denaturation or decomposition for example as a result of physical influences, oxidation or proteolytic cleavage.

Examples of enzyme stabilizers are reversible protease inhibitors, for example benzamidine hydrochloride, borax, boric acid, boronic acids or salts or esters thereof, including in particular derivatives with aromatic groups, for example ortho-, meta- or para-substituted phenyl boronic acids, in particular 4-formylphenyl boronic acid, or the salts or esters of the aforementioned compounds. Peptide aldehydes, i.e. oligopeptides with a reduced carbon terminus, in particular those made of 2 to 50 monomers, are also used for this purpose. Peptidic reversible protease inhibitors include inter alia ovomucoid and leupeptin. Specific, reversible peptide inhibitors for the protease subtilisin, as well as fusion proteins of proteases and specific peptide inhibitors are also suitable for this purpose.

Further examples of enzyme stabilizers are amino alcohols such as mono-, di-, triethanol- and -propanolamine and mixtures thereof, aliphatic mono- and dicarboxylic acids up to C12-carboxylic acids, such as for example succinic acid. Terminally capped fatty acid amide alkoxylates are also suitable enzyme stabilizers.

Other examples of enzyme stabilizers are sodium sulfite, reducing sugars and potassium sulfate. A further example of a suitable enzyme stabilizer is sorbitol.

As further additives (g), in connection with the dishwashing detergent formulations according to the invention, for example anionic or zwitterionic surfactants, alkali carriers, polymeric dispersants, corrosion inhibitors, antifoams, dyes, fragrances, fillers, tablet disintegrants, organic solvents, tableting auxiliaries, disintegrants, thickeners, solubility promoters, or water can be used. Alkali carriers that can be used are, for example, besides the ammonium or alkali metal carbonates, ammonium or alkali metal hydrogencarbonates and ammonium or alkali metal sesquicarbonates already specified for the builder substances, also ammonium or alkali metal hydroxides, ammonium or alkali metal silicates and ammonium or alkali metasilicates, and mixtures of the aforementioned substances.

As corrosion inhibitors, it is possible to use, inter alia, silver protectors from the group of triazoles, benzotriazoles, bisbenzotriazoles, aminotriazoles, alkylaminotriazoles and the transition metal salts or complexes.

To prevent glass corrosion, which is evident from clouding, iridescence, streaking and lines on the glassware, preference is given to using glass corrosion inhibitors. Preferred glass corrosion inhibitors are for example, magnesium, zinc and bismuth salts and complexes and polyethyleneimine.

Paraffin oils and silicon oils can optionally be used according to the invention as antifoams and for protecting plastic and metal surfaces. Antifoams are preferably used in fractions of from 0.001% by weight to 5% by weight. Moreover, dyes such as, for example, patent blue, preservatives such as, for example, Kathon CG, perfumes and other fragrances can be added to the cleaning formulation according to the invention.

A suitable filler in connection with the dishwashing detergent formulations according to the invention is, for example, sodium sulfate.

Further possible additives in connection with the present invention are amphoteric and cationic polymers.

In preferred embodiments, the dishwashing detergent formulations according to the invention are phosphate-free. In this connection, the term "phosphate-free" also comprises those dishwashing detergent formulations which comprise essentially no phosphate, i.e. phosphate in technically ineffective amounts. This comprises in particular compositions with less than 1.0% by weight, preferably less than 0.5% by weight, phosphate, based on the total composition.

In further preferred embodiments, the dishwashing detergent formulations of the invention are phosphate-free and phosphonate-free.

In particularly preferred embodiments, the dishwashing formulations comprises (a) 1-15% by weight, preferably 2 to 12% by weight, particularly preferably 3 to 10% by weight of the total composition, of
  - (a1) at least one of polyaspartic acid or modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of the co-condensates with the addition of a base, and
  - (a2) at least one graft copolymer composed of
    - (a21) at least one graft base selected from monosaccharides, disaccharides, oligosaccharides and polysaccharides, and side chains obtainable by grafting on of
    - (a22) at least one ethylenically unsaturated mono- or dicarboxylic acid and
    - (a23) at least one ethylenically unsaturated N-containing monomer with a permanent cationic charge, wherein the weight ratio of (a1):(a2) is from 12:1 to 1:3; preferably from 12:1 to 1:1, more preferably from 12:1 to 3:1;

(b) 1-50% by weight of methylglycinediacetic acid (MGDA), glutamic acid diacetic acid (GLDA) or salts thereof as complexing agent;

(c) 3-65% by weight of builders and/or cobuilders;

(d) 0.5-12% by weight of nonionic surfactants;

(e) 0-30% by weight of bleaches and bleach activators;

(f) 0.1-8% by weight of enzymes and enzyme stabilizers; and (g) 0-50% by weight of additives.

The examples below serve to illustrate the present invention and must not be understood as being a limitation thereof.

EXAMPLES

Example 1

Synthesis of Polyaspartic Acid, Sodium Salt (P1)

In a rotary evaporator, 133.10 g of L-aspartic acid were polycondensed for 2.5 h at a temperature of 220-240° C. The polysuccinimide was obtained as dry powder. In order to prepare the aqueous sodium salt solution of polyaspartic acid, 100 g of polysuccinimide was dispersed into 100 g of water, the mixture was heated to 70° C. and, at this temperature, enough of a 50% strength aqueous sodium hydroxide solution was added for the pH to be in the range of 7-8. During this, the powder dispersed in water gradually dissolved, giving a clear aqueous sodium salt solution of polyaspartic acid. The weight-average molecular weight (Mw) of the modified polyaspartic was 5500 g/mol (determined according to the method described in US 2016/0222322 A).

Example 2

Preparation of Graft Copolymer (P2)

Comonomers used:

(a.I): maltodextrin, commercially available as Cargill C*Dry MDOI 955

(b.I): acrylic acid (c.I): 2-(trimethylamino)ethylmethacrylatochloride ("TMAEMC")

In a stirred reactor, 220 g of (a.I) in 618 g of water were introduced and heated to 80° C. with stirring. At 80° C., the following solutions were metered in simultaneously and via separate feeds as follows:

a) An aqueous solution of 40.6 g of (c.I) in 149 g of water, over the course of 4 hours.

b) A solution of 9.85 g of sodium peroxodisulfate in 68.0 g of water over the course of 5 h, simultaneously starting with the metered addition of a).

c) A solution of 32.8 g of (b.I) and 36.5 g of sodium hydroxide solution (50% strength in water), diluted with 139 g of water, over the course of 2 hours, starting 2 hours after the start of the metered addition of a).

After the complete addition of solutions a) to c), the reaction mixture was stirred for one hour at 80° C. Then, a solution of 0.73 g of sodium peroxodisulfate in 10.0 g of water was added and the mixture was stirred for a further 2 hours at 80° C. Then, the mixture was cooled to room temperature and 8 g of biocide were added. This gave a 22.4% by weight solution of the graft copolymer.

Example 3

The ASTM D3556 spotting/filming tests are performed as follows:

Soil

Blue Bonnet 53% Vegetable Oil Spread 80 wt %

Meijer Brans Instant Nonfat Dry Milk 20 wt %

Water 300 ppm hardness (2:1 Ca:Mg)

Incoming at 120° F.

Amount of water 16.5 liters

Machine Type and Wash Program

Kenmore Dishwasher: Model 587.1401

Wash program: normal wash

Wash time: 50 minutes

Dry time: 14 minutes

Procedure 6 clean glasses (Libbey #53 10 oz highball glasses) are placed in top rackand remain there throughout (plates and silverware are loaded on bottom rack)

5 duplicate wash cycles (A,B) are performed (+heated dry), with 40 grams of fresh soil added per cycle Detergent also added per each cycle After 5$^{th}$ cycle, a light box is used to visually assign spot and film scores:

| | Rating |
|---|---|
| Spotting | |
| None | 1.0 |
| Random spots | 1.5 |
| ¼ surface spotted | 2.0 |
| ½ surface spotted | 3.0 |
| ¾ surface spotted | 4.0 |
| Totally spotted | 5.0 |
| Filming | |
| None | 1.0 |
| Barely perceptible | 1.5 |
| Slight | 2.0 |
| Moderate | 3.0 |
| Heavy | 4.0 |
| Very heavy | 5.0 |

TABLE 1

ADW Formulations (Phosphate and phosphonate free)

| Formulation A | wt % | Formulation B | wt % |
|---|---|---|---|
| Na Carbonate | 30 | Na Carbonate | 35 |
| Na Silicate | 10 | Na Silicate | 3 |
| Na Percarbonate | 10 | Na Percarbonate | 10 |
| Na Citrate | 4 | Na Citrate | 0 |
| MGDA | 4 | MGDA | 12 |
| Plurafac SLF 180 | 3 | Plurafac SLF 180 | 5 |
| EXCELLENZ P1000 | 0.75 | EXCELLENZ P1000 | 1.5 |
| EXCELLENZ S1000 | 0.75 | EXCELLENZ S1000 | 1.5 |
| TAED | 1.5 | TAED | 2 |
| Na Sulfate (anhy) | 36 | Na Sulfate (anhy) | 30 |
| SUM | 100 | SUM | 100 |

MGDA is methylglycine diacetic acid trisodium salt, 80 weight %, rest water

Plurafac ® SLF 180 is a low foaming alcohole alkoxylate surfactant (BASF Corporation)

EXCELLENZ ™ P1000 is a granular detergent protease enzyme (DuPont)

EXCELLENZ ™ S1000 is a granular detergent amylase enzyme (DuPont)

TAED = Tetraacetylethylenediamine

Results Formulation A

TABLE 2

| Average spot/film scores | | | | | | |
|---|---|---|---|---|---|---|
| Filming | | | | | | |
| Additive * | 3 wt % P1 | 3 wt % P1 0.15 wt % P2 | 3 wt % P1 0.25 wt % P2 | 3 wt % P1 0.50 wt % P2 | 3 wt % P1 3 wt % P2 | 1 wt % P1 3 wt % P2 |
| Glass Rating | 3.3 | 2.5 | 2.3 | 1.8 | 2.0 | 1.8 |
| Filming | | | | | | |
| Additive * | 0.5 wt % P1 3 wt % P2 | 0.25 wt % P1 3 wt % P2 | 3 wt % P2 | No additive | | |
| Glass Rating | 2.0 | 2.4 | 2.8 | 2.8 | | |
| Spotting | | | | | | |
| Additive * | 3 wt % P1 | 3 wt % P1 0.15 wt % P2 | 3 wt % P1 0.25 wt % P2 | 3 wt % P1 0.50 wt % P2 | 3 wt % P1 3 wt % P2 | 1 wt % P1 3 wt % P2 |
| Glass Rating | 1.2 | 1.3 | 1.3 | 1.2 | 1.3 | 1.2 |
| Spotting | | | | | | |
| Additive * | 0.5 wt % P1 3 wt % P2 | 0.25 wt % P1 3 wt % P2 | 3 wt % P2 | No additive | | |
| Glass Rating | 1.3 | 1.3 | 1.4 | 1.6 | | |

* wt % active material

Results Formulation B

TABLE 3

| Average spot/film scores | | | | | | | |
|---|---|---|---|---|---|---|---|
| Filming | | | | | | | |
| Additive * | 5 wt % P1 | 5 wt % P1 0.25 wt % P2 | 5 wt % P1 0.50 wt % P2 | 5 wt % P1 2 wt % P2 | 3 wt % P1 3 wt % P2 | 1 wt % P1 3 wt % P2 | No additive |
| Glass Rating | 3.4 | 2.6 | 2.0 | 1.6 | 1.9 | 2.3 | 2.6 |
| Spotting | | | | | | | |
| Additive * | 5 wt % P1 | 5 wt % P1 0.25 wt % P2 | 5 wt % P1 0.50 wt % P2 | 5 wt % P1 2 wt % P2 | 3 wt % P1 3 wt % P2 | 1 wt % P1 3 wt % P2 | No additive |
| Glass Rating | 1.2 | 1.3 | 1.2 | 1.3 | 1.2 | 1.2 | 1.3 |

* wt % active material

Example 4

Aqueous solutions of polyaspartic acid, sodium salt (P1) and graft copolymer (P2) (20 and 40 weight %, based on solid material) were prepared by mixing of predissolved (P1) and (P2). Different (P1):(P2) weight ratio were applied: 20:1, 12:1, 8:1, 6:1, 4:1, 1:1, 1:3, 1:12

Even after three months storage at 22-25° C. no polymer/polymer incompatibilities were observed.

A build-up test was performed as follows

Dishwasher: Miele G 1222 SCL

Program: 65° C. in main cycle (with prewash), 65° C. rinse temperature, no rinse aid was used, no regenerating salt for ion exchange resin was used Dishes: 3 knives (WMF Tafelmesser Berlin, monobloc)

3 Amsterdam 0.2 L drinking glasses

3 "OCEAN BLAU" breakfast plates (MELAMINE)

3 porcelain plates: 19 cm plates with rims flat

Ballast dishes 8 tea cups, 8 porcelain plates

Arrangement: Knives in the cutlery drawer, glasses in the upper baskets, plates in the lower basket Dosage: 18 g of dishwashing detergent Ballast soil: 50 g of ballast soil is added with the formulation after the prewash; for composition see below Water hardness: 21° German hardness (Ca/Mg):HCO3 (3:1):1.35

Wash cycles: 30; break in between for 1 h in each case (10 min with door open, 50 min with door closed)

Evaluation: Visually after 30 wash cycles

The evaluation of the dishes was carried out after 30 cycles in a darkened chamber under light behind an aperture diaphragm using a grading scale from 10 (very good) to 1 (very poor). Grades from 1-10 for filming (1=very severe filming, 10=no filming) were awarded.

Composition of the Ballast Soil:
Starch: 0.5% potato starch, 2.5% gravy
Fat: 10.2% margarine
Protein: 5.1% egg yolk, 5.1% milk
Others: 2.5% tomato ketchup, 2.5% mustard, 0.1% benzoic acid, 71.4% water The following base detergent compositions were used:

TABLE 4

| (weight %) | F1 | F2 | F3 |
|---|---|---|---|
| Citric acid trisodiumsalt dihydrate | 35 | 35 | 0 |
| MGDA | 10 | 10 | 45 |
| Natriumpercarbonate, $2\ Na_2CO_3 \cdot 3\ H_2O_2$ | 10.19 | 10.19 | 10.19 |
| Nonionic surfactant 1 | 4 | 4 | 4 |
| Nonionic surfactant 2 | 1 | 1 | 1 |
| Protease | 2.5 | 2.5 | 2.5 |
| Amylase | 1 | 1 | 1 |
| $Na_2Si_2O_5$ | 2 | 2 | 2 |
| TAED | 4 | 4 | 4 |
| $Na_2CO_3$ | 24.5 | 24.5 | 24.5 |
| HEDP | 0.81 | | |
| Gap | | 0.81 | 0.81 |
| Polymer | 5 | 5 | 5 |

MGDA: Methylglycine diacetic acid trisodium salt, 80 weight-%, rest water
Nonionic surfactant 1: $n—C_8H_{17}—CH(OH)—CH_2—O—(EO)_{22}—CH(CH_3)—CH_2—O—n—C_{10}H_{21}$
Nonionic surfactant 2: $n—C_{10}H_{21}—CH(OH)—CH_2—O—(EO)_{40}—n—C_{10}H_{21}$
$Na_2Si_2O_5$: commercially available as Britesil ® H265 LC
HEDP: 1-Hydroxyethane-1,1-diphosphonate disodium salt
TAED: Tetraacetylethylenediamine
Polymer: P1, P2, M1, M2, M3, M4 (active material)
M1 = aqueous mixture (40 weight %) of P1 and P2 (P1:P2 weight ratio 4:1)
M2 = aqueous mixture (40 weight %) of P1 and P2 (P1:P2 weight ratio 8:1)
M3 = aqueous mixture (40 weight %) of P1 and P2 (P1:P2 weight ratio 12:1)
M4 = aqueous mixture (40 weight %) of P1 and P2 (P1:P2 weight ratio 1:1)

Filming Results on Glass

TABLE 5

| Average film scores | | | | | | |
|---|---|---|---|---|---|---|
| Detergent composition | F1 | F1 | F1 | F1 | F1 | F1 |
| Additive * | 5 wt % P1 | 5 wt % M1 | 5 wt % M2 | 5 wt % M3 | 5 wt % M4 | 5 wt % P2 |
| Glass Rating | 3.0 | 5.0 | 4.7 | 4.3 | 4.3 | 3.3 |
| Detergent composition | F2 | F2 | F2 | F2 | F2 | F2 |
| Additive * | 5 wt % P1 | 5 wt % M1 | 5 wt % M2 | 5 wt % M3 | 5 wt % M4 | 5 wt % P2 |
| Glass Rating | 3.0 | 4.3 | 4.3 | 4.0 | 3.7 | 2.7 |
| Detergent composition | F3 | F3 | F3 | F3 | F2 | F3 |
| Additive * | 5 wt % P1 | 5 wt % M1 | 5 wt % M2 | 5 wt % M3 | 5 wt % M4 | 5 wt % P2 |
| Glass Rating | 4.0 | 5.3 | 5.0 | 4.7 | 4.3 | 3.7 |

* wt % active material

The invention claimed is:

1. A phosphate-free and phosphonate-free dishwashing detergent formulation comprising:

(a) 1-15% by weight of the total formulation of (a1) modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of co-condensates with an addition of a base, and (a2) at least one graft copolymer composed of (a21) maltodextrin as graft base, and side chains obtainable by grafting on of (a22) acrylic acid, and (a23) 2-(trimethylamine)ethyl-methacrylatochloride (TMAEMC), wherein a weight ratio of (a1):(a2) is from 12:1 to 4:1;

(b) 45 to 60% by weight of methylglycinediacetic acid (MGDA) or salts thereof as complexing agent;

(c) 3-65% by weight of builders and/or cobuilders;

(d) 0.5-10% by weight of nonionic surfactants;

(e) 0-30% by weight of bleaches and bleach activators;

(f) 0.1-8% by weight of enzymes and enzyme stabilizers; and (g) 0-50% by weight of additives.

2. The dishwashing detergent formulation according to claim 1, wherein (i) is 80 to 95 mol % of aspartic acid and (ii) is 5 to 20 mol % of the at least one carboxyl-containing compound different from aspartic acid.

3. The dishwashing detergent formulation of claim 2, wherein the at least one carboxyl-containing compound (ii) is selected from the group consisting of 1,2,3,4-butanetetracarboxylic acid, citric acid, glycine and glutamic acid.

4. A method of film inhibition in phosphate-free and phosphonate-free automatic dishwashing detergent formulations, the method comprising:

using a phosphate-free and phosphonate-free automatic dishwashing detergent formulation comprising:

(a1) modified polyaspartic acid or salts thereof, wherein the modified polyaspartic acid is obtainable by polycondensation of (i) 50 to 99 mol % of aspartic acid and (ii) 1 to 50 mol % of at least one carboxyl-containing compound different from aspartic acid and subsequent hydrolysis of the co-condensates with the addition of a base, (a2) at least one graft copolymer composed of (a21) maltodextrin as graft base, and side chains obtainable by grafting on of (a22) acrylic acid, and (a23) 2-(trimethylamine)ethyl-methacrylatochloride (TMAEMC), wherein the weight ratio of (a1):(a2) is from 12:1 to 4:1;

as a film inhibition additive in the phosphate-free and phosphonate-free automatic dishwashing detergent formulation according to claim 1.

* * * * *